US008528169B1

(12) United States Patent
Yu

(10) Patent No.: US 8,528,169 B1
(45) Date of Patent: Sep. 10, 2013

(54) PATCH FITTING WITH AUTO-RETURN FUNCTION

(71) Applicant: Leado Door Controls Ltd., Yuanlin Township, Changhua County (TW)

(72) Inventor: King-Sung Yu, Yuanlin Township, Changhua County (TW)

(73) Assignee: Leado Door Controls Ltd., YuanLin Township, ChangHua County (TW)

( * ) Notice: Subject to any disclaimer, the term of this patent is extended or adjusted under 35 U.S.C. 154(b) by 0 days.

(21) Appl. No.: 13/708,595

(22) Filed: Dec. 7, 2012

(30) Foreign Application Priority Data

Sep. 11, 2012 (TW) ..... 101217531 A

(51) Int. Cl.
*E05F 3/04* (2006.01)
*E05D 7/04* (2006.01)
*E05D 5/02* (2006.01)

(52) U.S. Cl.
USPC ..... 16/51; 16/54; 16/82; 16/238; 16/252

(58) Field of Classification Search
USPC ..... 16/49–55, 58–60, 82, 85, DIG. 9, 16/DIG. 10, 252, 235–238, 242, 245, 250; 49/398
See application file for complete search history.

(56) References Cited

U.S. PATENT DOCUMENTS

| | | | | |
|---|---|---|---|---|
| 3,449,789 | A * | 6/1969 | Russell et al. | 16/55 |
| 3,828,394 | A * | 8/1974 | Horgan, Jr. | 16/241 |
| 5,417,013 | A * | 5/1995 | Tillmann | 49/386 |
| 6,070,294 | A * | 6/2000 | Perkins et al. | 16/252 |
| 6,442,795 | B1 * | 9/2002 | Chen | 16/53 |
| 6,481,055 | B2 * | 11/2002 | Cheng | 16/252 |
| 7,673,373 | B2 * | 3/2010 | Chang et al. | 16/250 |
| 7,900,319 | B2 * | 3/2011 | Bacchetti | 16/252 |
| 8,181,311 | B2 * | 5/2012 | Chiang et al. | 16/78 |
| 2010/0275409 | A1 * | 11/2010 | Walhorn et al. | 16/235 |
| 2012/0216370 | A1 * | 8/2012 | Chow | 16/54 |
| 2012/0279015 | A1 * | 11/2012 | Hung | 16/297 |
| 2012/0311817 | A1 * | 12/2012 | Bacchetti | 16/51 |

* cited by examiner

*Primary Examiner* — William Miller
(74) *Attorney, Agent, or Firm* — Muncy, Geissler, Olds & Lowe, PLLC

(57) ABSTRACT

A patch fitting with auto-return function for a glass door includes a clamping seat, a damper and a misalignment adjuster. The clamping seat is adapted for clamping and being mounted on the top edge of the glass door and comprises a shaft body and an eccentric cam connected with the shaft body. The damper is installed in the clamping seat and contacted with the eccentric cam. The misalignment adjuster comprises a mounting plate, a plurality of adjustment members and an adjustment plate. The mounting plate has a concave space and a plurality of adjustment holes communicated with the concave space. Each of the adjustment members is disposed in each of the adjustment holes. The adjustment plate is arranged in the concave space of the mounting plate, connected with the shaft body and stopped by at least one of the adjustment members.

10 Claims, 8 Drawing Sheets

PATCH FITTING WITH AUTO-RETURN FUNCTION

BACKGROUND OF THE INVENTION

1. Field of the Invention

The present invention relates generally to a patch fitting and more particularly, to a patch fitting with auto-return function which can easily compensate the offset of a glass door.

2. Description of the Related Art

Conventionally, when a glass door is installed, the door panel and door frame are drilled respectively to form a number of hinge holes and a hinge is then fastened to the hinge holes for enabling the glass door to pivotally opened or closed. Because a tolerance may be occurred during the drilling process, the door panel may not be aligned with the door frame while closing the glass door if the hinge is forced to be fastened to the hinge holes under such condition. In order to solve the tolerance of drilling, installers would commonly grind the hinge holes to be of a larger diameter prior to the installation of the hinge. However, the grinding of the hinge holes may cause the glass door to crack or may reduce the distance between two adjacent hinge holes, thus causing fractures in the glass therebetween.

In view of the above, the installation of glass door utilizing traditional hinges is troublesome and the glass door is unable to close positively since the tolerance occurred after the installation; therefore, traditional hinges are not suitable for glass doors.

SUMMARY OF THE INVENTION

The present invention has been accomplished in view of the above-noted circumstances. It is an objective of the present invention to provide a patch fitting with auto-return function for a glass door, which can be easily installed on a glass door and can compensate the offset of the glass door promptly.

To attain the above-mentioned objective, the patch fitting with auto-return function for a glass door provided by the present invention comprises a clamping seat, a damper and a misalignment adjuster. The clamping seat has a seat body and a shaft. The seat body is adapted for clamping and being mounted on the top edge of the glass door and has an oil chamber for the storage of hydraulic oil and a shaft hole in fluid communication with and perpendicular to the oil chamber. The shaft is pivotally inserted into the shaft hole of the seat body and has a shaft body with an end protruding out of the shaft hole, and an eccentric cam provided on the shaft body. The damper is installed in the oil chamber and contacted with the eccentric cam for being pushed by the eccentric cam to press hydraulic oil contained in the oil chamber to provide a damping resistance in response to a sweeping movement of the glass door. The misalignment adjuster comprises a mounting plate, a plurality of adjustment members and an adjustment plate. A center of the mounting plate has a concave space and a periphery of the mounting plate is provided with a plurality of adjustment holes communicated with the concave space. Each of the adjustment members is disposed in one of the adjustment holes. The adjustment plate, which is smaller in dimension than the concave space, is arranged in the concave space of the mounting plate, connected with the end of the shaft body of the shaft and stopped by at least one of the adjustment members, such that the adjustment plate can be actuated by at least one of the adjustment members to move in the concave space. In this way, the front/rear offset, the left/right offset and the rotational offset of the glass door can be compensated by adjusting the position of the clamping seat.

In a preferred embodiment of the present invention, the mounting plate has a rectangle shape and each lateral side of the mounting plate is provided with at least one of the adjustment holes. It is preferred that each of the adjustment members is screwingly inserted in one of the adjustment holes.

In a preferred embodiment of the present invention, the adjustment plate has an insertion hole into which the end of the shaft body of the shaft is inserted, such that the adjustment plate and the shaft body of the shaft can be connected to each other.

BRIEF DESCRIPTION OF THE DRAWING

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
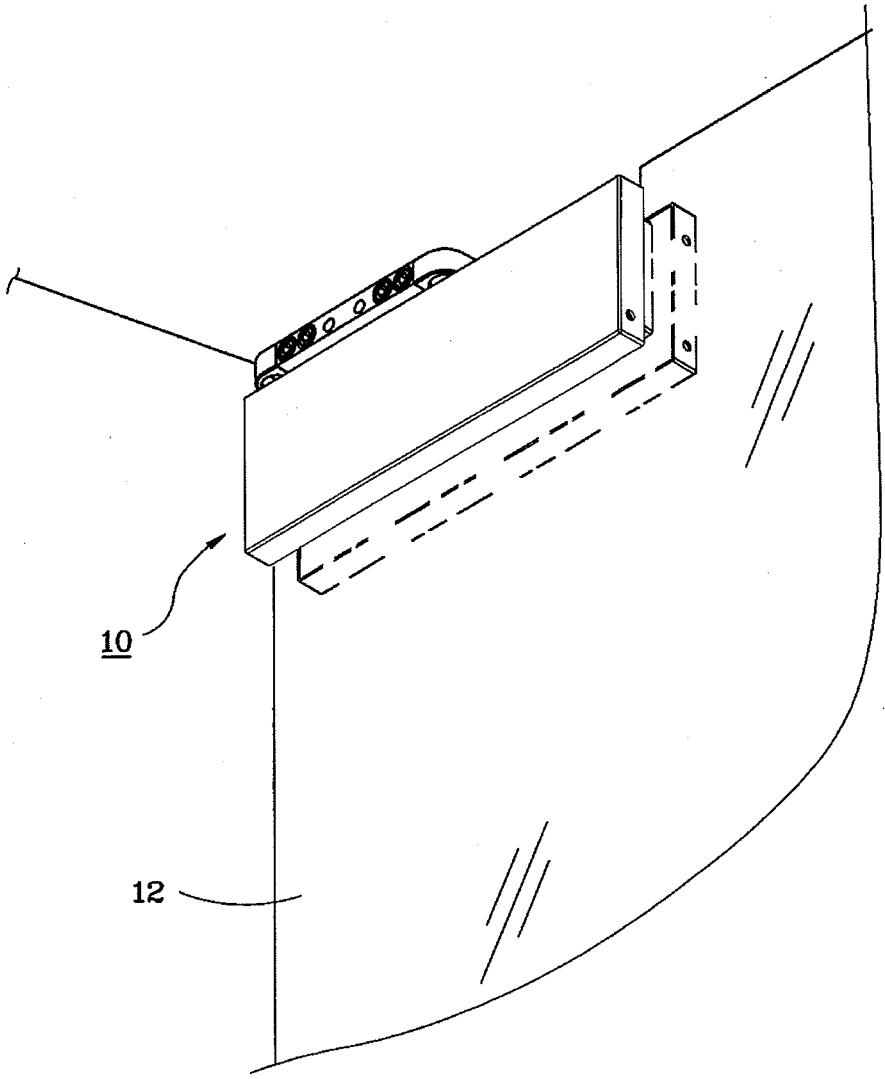
FIG. 1 is a schematic perspective view showing a patch fitting in accordance with a preferred embodiment of the present invention is coupled with a glass door.
Figure 2:
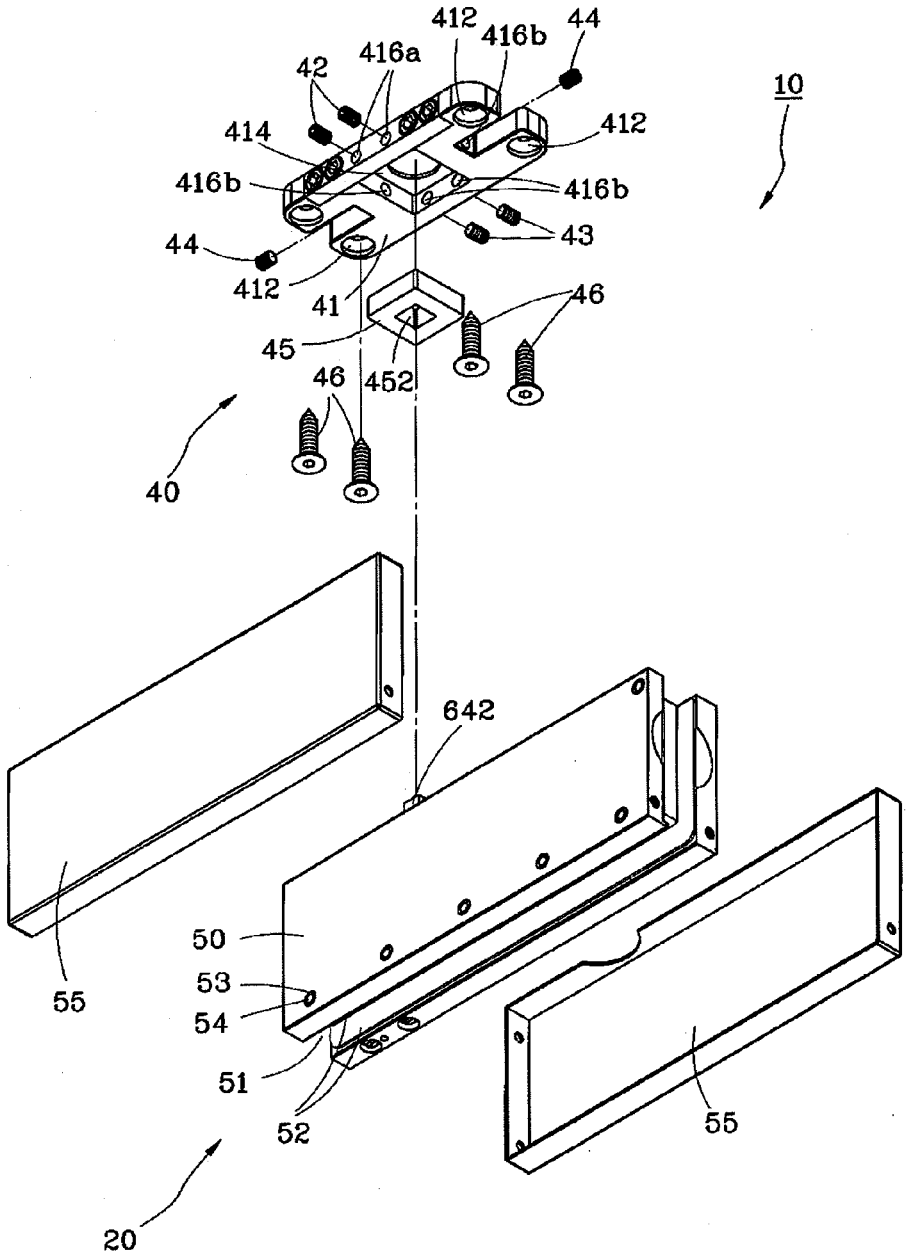
FIG. 2 is a partially exploded view of the patch fitting in accordance with the preferred embodiment of the present invention.
Figure 3:
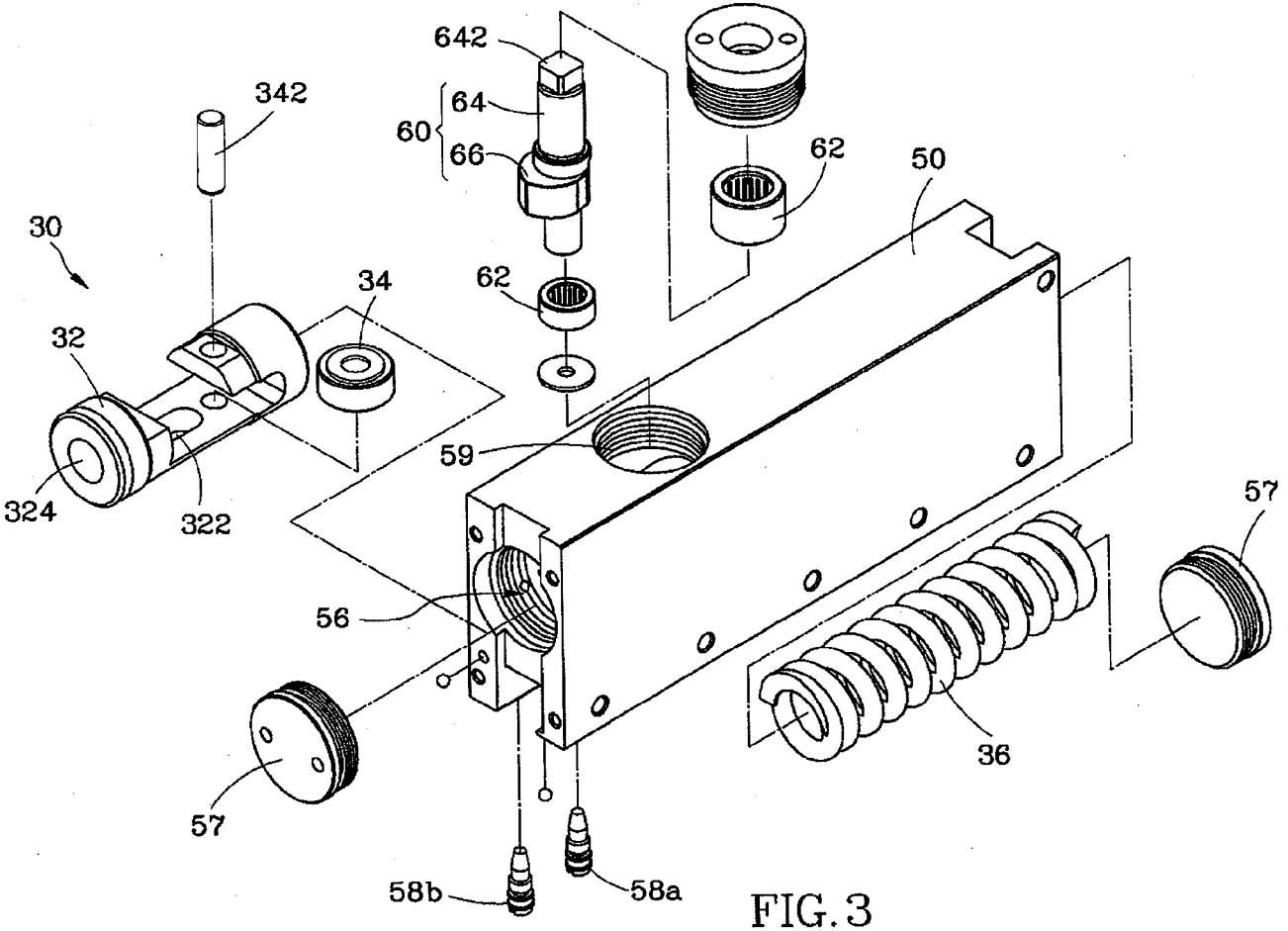
FIG. 3 is an exploded view of the clamping seat of the patch fitting in accordance with the preferred embodiment of the present invention.

As shown in FIGS. 1-3, the patch fitting 10 with auto-return function for a glass door 12 provided according to a preferred embodiment of the present invention comprises a clamping seat 20, a damper 30, and a misalignment adjuster 40.

The clamping seat 20 includes a seat body 50 and a shaft 60 as shown in FIGS. 2 and 3.

Figure 4:
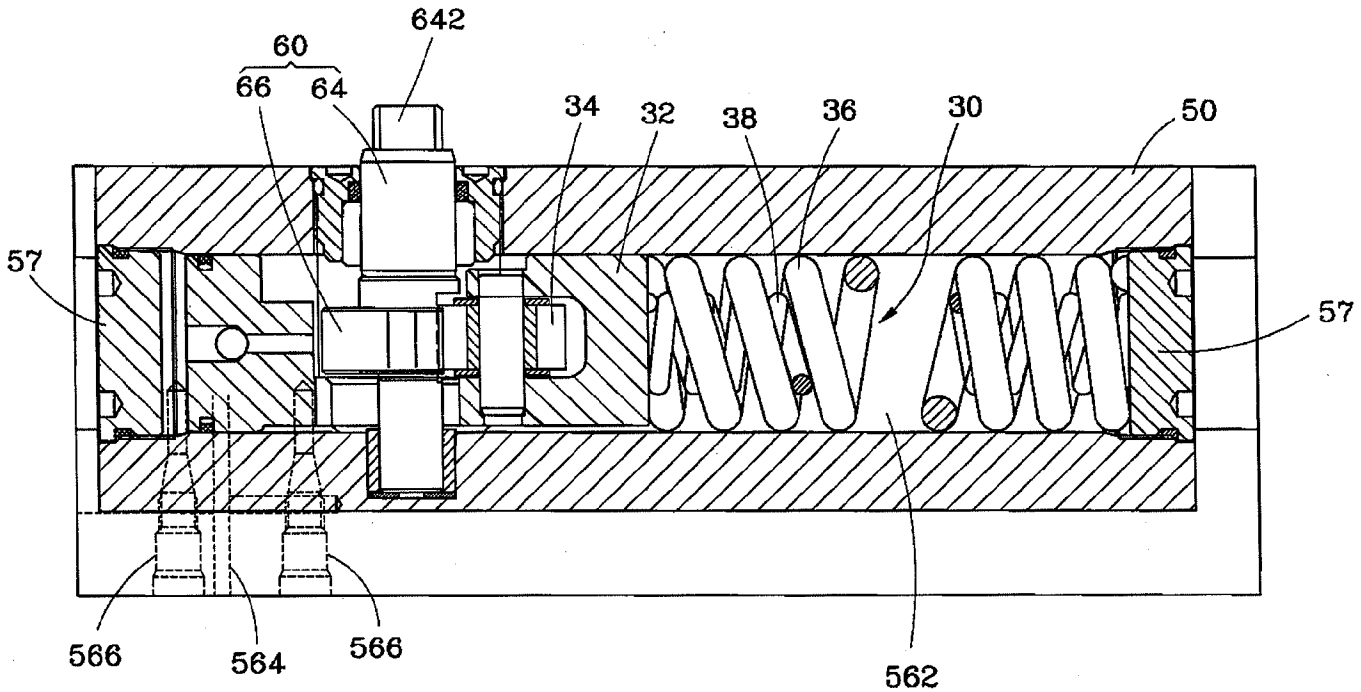
FIG. 4 is a cross-sectional view of the clamping seat of the patch fitting in accordance with the preferred embodiment of the present invention.
Figure 5A:
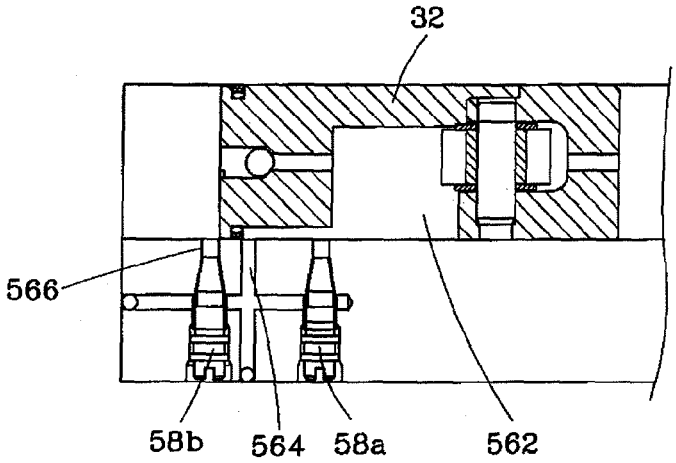
FIG. 5A to FIG. 5D are cross-sectional views of the clamping seat showing the processes of how the damper presses the hydraulic oil.

A bottom edge of the seat body 50 has a clamping groove 51 for insertion of a top edge of the glass door 12. Two opposite clamping pieces 52 are arranged in the clamping groove 51 for preventing the damage of the glass door 12 caused by the direct contact between the seat body 50 and the glass door 12. Two decorative plates 55 may be respectively mounted on the two side walls of the seat body 50 to decorate the appearance of the seat body 50 according to the user's need. The two side walls of the seat body 50 are provided with a plurality of through holes 53 communicated with the clamping groove 51. A plurality of fasteners 54 screwingly inserted in the through holes 53 are urged against the clamping pieces 52 such that the clamping pieces 52 can be pushed by these fasteners 54 to firmly clamp the top edge of the glass door 12 therebetween so as to fix the seat body 50 to the glass door 12. As shown in FIGS. 3 and 4, the seat body 50 is provided at its inside with an oil chamber 56 for the storage of hydraulic oil. Two end caps 57 are disposed at the two ends of the seat body 50 to seal the oil chamber 56. Further, as shown in FIG. 5A, the oil chamber 56 can be divided into a compartment 562 and an oil channel 564. Additionally, the top surface of the seat body 50 is provided with a shaft hole 59 perpendicular to and in fluid communication with the oil chamber 56, and the bottom surface of the seat body 50 is provided with two valve holes 566 spaced from each other and in fluid communication with the oil chamber 56. Two regulation valves 58*a* and 58*b* are respectively mounted in the valve holes 566 as shown in FIG. 5A.

The shaft 60 is pivotally inserted into the shaft hole 59 of the seat body 50 by two bearings 62 and has a shaft body 64 with an insertion end 642 protruding out of the shaft hole 59, and an eccentric cam 66 provided on the shaft body 64.

The damper 30 is installed in the compartment 562 of the oil chamber 56 of the clamping seat 20, and comprises a piston 32, a contact member 34 and two springs 36 and 38. The piston 32 has an elongated through hole 322 through which the shaft body 64 of the shaft 60 passes, and two oil passages 324 at two ends thereof for conducting hydraulic oil as shown in FIG. 3. The contact member 34 is mounted to the piston 32 by a pivot pin 342 and in contact with the eccentric cam 66 of the shaft 60, such that the contact member 34 will be pushed by the eccentric cam 66 to move the piston 32 to press the hydraulic oil to provide a damping resistance in response to the sweeping movement of the glass door. The spring 36 has two ends respectively stopped at the end surface of the piston 32 and the end cap 57 of the clamping seat 20 for providing a rebound force. The spring 38 is inserted into inside of the spring 36 and has two ends respectively stopped at the end surface of the piston 32 and the end cap 57 of the clamping seat 20 for providing a rebound force and a resilient compensation effect. One of the springs 36 and 38 can be eliminated according to actual need.

Figure 6A:
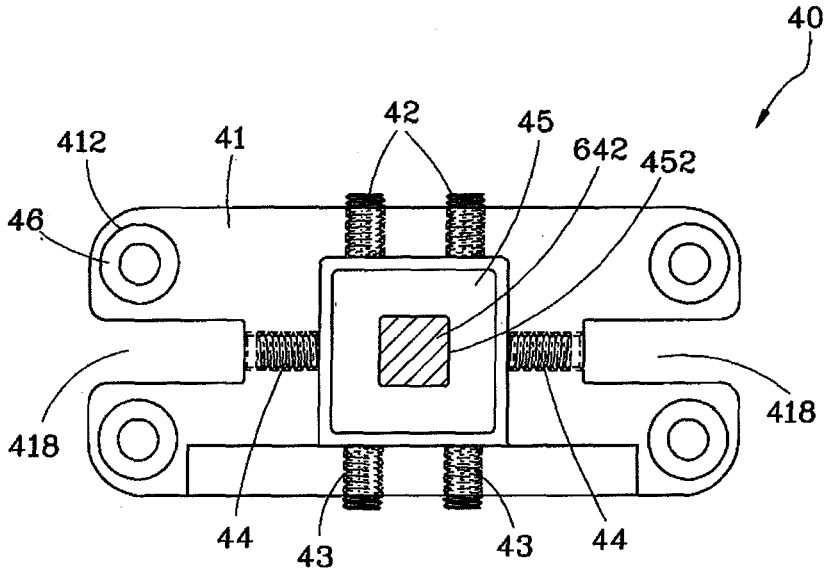
FIG. 6A to FIG. 6D are bottom views of the misalignment adjuster of the patch fitting of the preferred embodiment of the present invention, showing the ways of how to compensate the offset of the glass door.

The misalignment adjuster 40 comprises a mounting plate 41, two first adjustment members 42, two second adjustment members 43, two third adjustment members 44, and an adjustment plate 45 as shown in FIGS. 2 and 6A. The mounting plate 41 is rectangle shaped and each corner of the mounting plate 41 is provided with a mounting hole 412. Four bolts 46 are respectively passes through the mounting holes 412 to fixedly install the mounting plate 41 on a door frame. The mounting plate 41 is provided with a rectangle concave space 414 at its center, four threaded adjustment holes 416*a* respectively located at the two opposite long sides thereof, two threaded adjustment holes 416*b* respectively located at the two opposite short sides thereof, and two notches 418 respectively communicated with the threaded adjustment holes 416*b* for insertion of a tool. All of the threaded adjustment holes 416*a* and 416*b* are communicated with the concave space 414. The first and second adjustment members 42 and 43 are respectively screwingly inserted in the threaded adjustment holes 416*a* of the mounting plate 41, and the third adjustment members 44 are respectively screwingly inserted in the threaded adjustment holes 416*b* of the mounting plate 41. The adjustment plate 45 is arranged in the concave space 414 of the mounting plate 41 and provided with an insertion hole 452 for securing the insertion end 642 of the shaft body 64 of the shaft 60. In addition, the adjustment plate 45 is smaller in dimension than the concave space 414, such that the adjustment plate 45 can be stopped and pushed by at least one of the adjustment members 42, 43 and 44 to move or to rotate inside the rectangle concave space 414, thereby actuating the clamping seat 20 through the conjunction between the adjustment plate 45 and shaft 60 during the process of movement or rotation of the adjustment plate 45.

The structure of the patch fitting 10 has been detailedly described as above and the feature and operation of the patch fitting 10 will be further recited hereinafter.

Figure 5B:
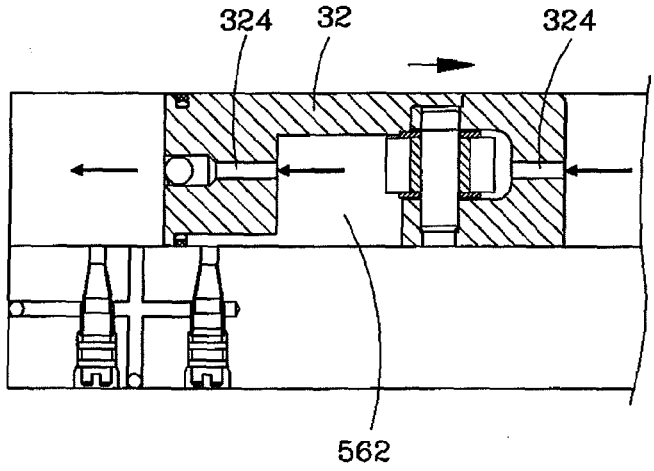

When the glass door 12 is pushed to open, the clamping seat 20 will turn along with the sweeping movement of the glass door 12 about the shaft 60, which is served as a pivot center. At this moment, the piston 32 is pushed by the eccentric cam 66 of the shaft 60 to move in the oil chamber 56, resulting in that the hydraulic oil that is pressed by the piston 32 will flow from a right side of the piston 32 through the oil passages 324 to a left side of piston 32 as shown in FIGS. 5A and 5B.

Figure 5C:
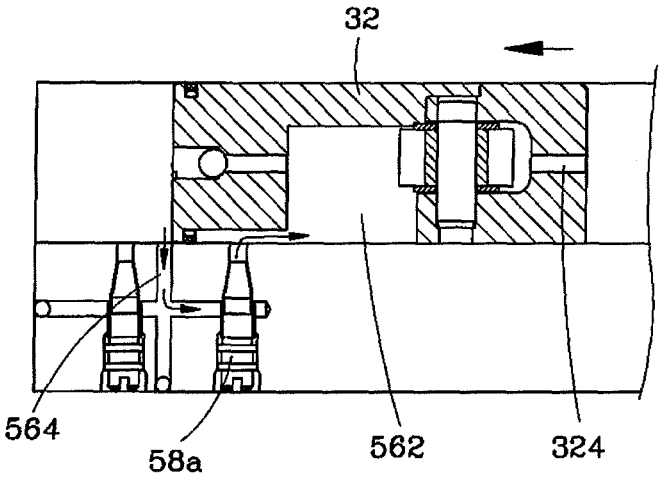
Figure 5D:
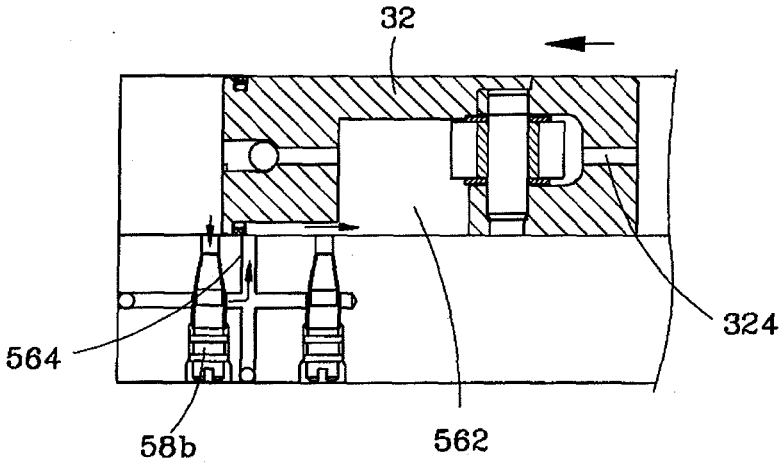

When the glass door 12 is closed, in an initial stage the piston 32 will be pushed by the spring 36 to move in a reverse direction to force the hydraulic oil to flow through the oil channel 564 and the regulation valve 58*a* into the compartment 562 and then flow toward the right side of the piston 32 through one of the oil passages 324, as shown in FIG. 5C. When the glass door 12 is continuously closed to an extent that the entrance of the oil channel 564 is blocked by the piston 32, the hydraulic oil will be forced to flow through the regulation valve 58*b* and the oil channel 564 into the compartment 562 and then flow toward the right side of the piston 32 through one of the oil passages 324, as shown in FIG. 5D, until the glass door 12 is completely closed. The sweeping speed of the glass door 12 at different door closing stages can be adjusted by adjustment of the flow rate of the hydraulic oil through the regulation valve 58*a* and/or the regulation valve 58*b*.

Figure 6B:
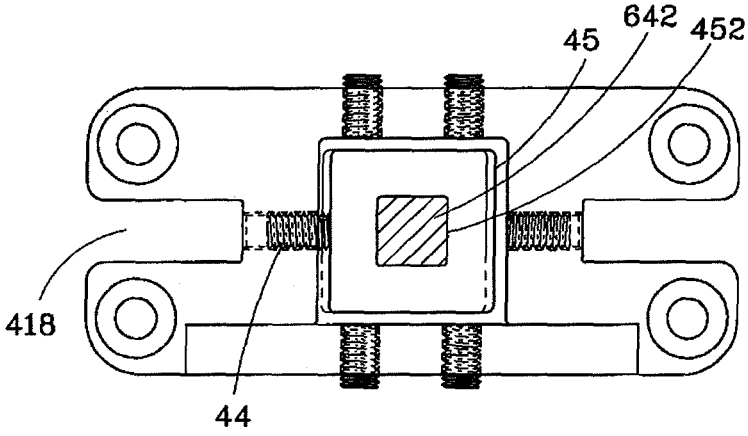
Figure 6C:
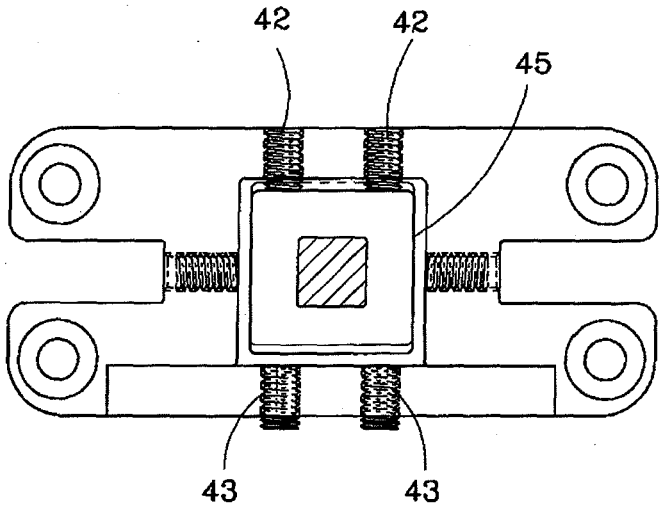
Figure 6D:
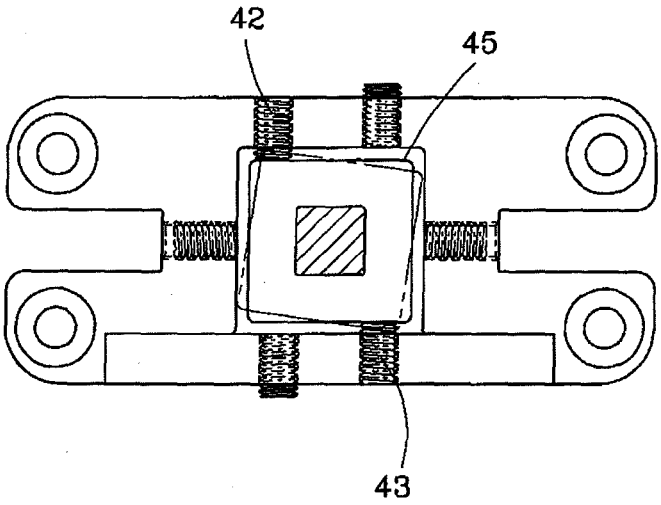

On the other hand, if a left/right offset of the glass door 12 happens when the glass door 12 is stayed in the closed position as shown in FIG. 6B, a tool that is used to insert into the notch 418 can rotate one of the third adjustment members 44 to cause the end of the third adjustment members 44 to push the adjustment plate 45. In this way, since the adjustment plate 45 is assembled with the clamping seat 20 through insertion of the insertion end 642 into the insertion hole 452, the clamping seat 20 and the glass door 12 are together moved along with the adjustment plate 45 until the left/right offset of the glass door 12 is compensated. Further, if a front/rear offset of the glass door 12 happens when the glass door 12 is stayed in the closed position as shown in FIG. 6C, the front/rear offset can be compensated through the clamping seat 20 by rotating two first adjustment members 42 or two second adjustment members 43 to force the ends of the first adjustment members 42 or the second adjustment members 43 to push the adjustment plate 45. Additionally, if a rotational offset of the glass door 12 happens when the glass door 12 is stayed in the closed position as shown in FIG. 6D, the rotational offset can be compensated by rotating one of the first adjustment members 42 and one of the second adjustment members 43 to force the adjustment plate 45 to rotate.

As indicated above, the patch fitting 10 can be fixedly installed on the door frame by four bolts 46, thereby simplifying the work of installation. In addition, the patch fitting 10 can provide a hydraulic oil damping resistance generated between the damper 30 and the hydraulic oil to buffer the force for opening or closing the glass door 12. Further, after the patch fitting 10 is installed, the position of the glass door 12 can be lightly adjusted to improve the misalignment of the glass door 12 so as to make sure that the glass door 12 can be closed positively.

What is claimed is:

1. A patch fitting with auto-return function for a glass door, comprising:

a clamping seat having a seat body for clamping a top edge of the glass door and a shaft; wherein the seat body has an oil chamber for storage of hydraulic oil and a shaft hole in fluid communication with and perpendicular to the oil chamber, and the shaft is pivotally inserted into the shaft hole of the seat body and has a shaft body with an end protruding out of the shaft hole and an eccentric cam provided on the shaft body;

a damper installed in the oil chamber and contacted with the eccentric cam of the shaft for being pushed by the eccentric cam to press the hydraulic oil contained in the oil chamber to provide a damping resistance in response to a sweeping movement of the glass door; and a misalignment adjuster including a mounting plate having a center provided with a concave space and a periphery provided with a plurality of adjustment holes communicated with the concave space, a plurality of adjustment members each moveably mounted in one of the adjustment holes, and an adjustment plate, which is smaller in dimension than the concave space, arranged in the concave space of the mounting plate, connected with the end of the shaft body of the shaft and stopped by at least one of the adjustment members, such that a position of the clamping seat is adjustable by movements of the adjustment members.

2. The patch fitting with auto-return function of claim 1, wherein the mounting plate has a rectangle shape and each lateral side of the mounting plate is provided with at least one said adjustment hole.

3. The patch fitting with auto-return function of claim 1, wherein each of the adjustment members is screwingly inserted in one of the adjustment holes.

4. The patch fitting with auto-return function of claim 1, wherein both of the concave space of the mounting plate and the adjustment plate have a rectangular shape.

5. The patch fitting with auto-return function of claim 1, wherein the adjustment plate has an insertion hole into which the end of the shaft body of the shaft is inserted.

6. The patch fitting with auto-return function of claim 1, wherein the clamping seat further comprises two clamping pieces and a plurality of fasteners; a bottom edge of the seat body has a clamping groove for insertion of a top edge of the glass door; two opposite side walls of the seat body are respectively provided with a plurality of through holes communicated with the clamping groove; the clamping pieces are arranged in the clamping groove for abutting against two opposite surfaces of the glass door; the fasteners are respectively inserted in the through holes and urged against the clamping pieces.

7. The patch fitting with auto-return function of claim 6, wherein the fasteners are screwingly inserted in the through holes.

8. The patch fitting with auto-return function of claim 1, wherein the clamping seat further comprises two regulation valves; the seat body has two valve holes respectively in fluid communication with the oil chamber; the regulation valves are respectively installed in the valve holes.

9. The patch fitting with auto-return function of claim 8, wherein the oil chamber of the clamping seat includes a compartment in which the damper is installed, and an oil channel in fluid communication with the compartment.

10. The patch fitting with auto-return function of claim 1, wherein the damper includes a piston with an elongated through hole through which the shaft body of the shaft passes, a contact member mounted to the piston and contacted with the eccentric cam of the shaft, and a spring having one end abutting at the piston.

* * * * *